United States Patent [19]

Malofsky et al.

[11] 3,969,552

[45] July 13, 1976

[54] PROCESS FOR IMPREGNATING POROUS ARTICLES

[75] Inventors: Bernard M. Malofsky, Bloomfield; Elliott Frauenglass; Harold A. Fowler, both of Newington, all of Conn.

[73] Assignee: Loctite Corporation, Newington, Conn.

[22] Filed: May 8, 1974

[21] Appl. No.: 467,989

[52] U.S. Cl. ..... 427/295; 134/38; 252/89 R; 252/DIG. 1; 252/DIG. 8; 427/340; 427/350

[51] Int. Cl.[2] ..... B08B 7/00; C23D 17/00; B05D 3/00

[58] Field of Search ..... 117/8, 10, 62.2, 63, 117/102 R, 113, 118, 119, 132 B, 132 C, 161 K; 427/295, 340, 350; 134/38; 252/DIG. 8, DIG. 1, 89

[56] References Cited

UNITED STATES PATENTS

| | | | |
|---|---|---|---|
| 1,812,322 | 6/1931 | Davidson | 252/DIG. 8 |
| 2,554,254 | 5/1951 | Kroft | 117/61 |
| 2,710,843 | 6/1955 | Stebleton | 252/DIG. 8 |
| 2,932,583 | 4/1960 | Grana | 117/61 X |
| 2,969,328 | 1/1961 | Ellenson et al. | 252/DIG. 8 |
| 3,345,205 | 10/1967 | Raech | 117/119 |
| 3,663,476 | 5/1972 | Murphy | 134/38 X |
| 3,672,942 | 6/1972 | Newmann et al. | 117/62.2 |
| 3,701,676 | 10/1972 | Bader et al. | 117/49 |

*Primary Examiner*—Michael R. Lusignan
*Attorney, Agent, or Firm*—Jean B. Mauro

[57] ABSTRACT

Porous articles impregnated with certain anaerobic polymerizable sealants and having a coating of such sealant on their surface can have such coating removed by dissolving the sealant in an aqueous solution of a surfactant having the general formula $X^1—O(C_2H_4O)_xX^2$. The removal can be done at room temperature.

37 Claims, No Drawings

PROCESS FOR IMPREGNATING POROUS ARTICLES

BACKGROUND OF THE INVENTION

Porous articles, and particularly porous metal articles such as castings and sintered metal parts, frequently must be sealed and impregnated (for simplicity, hereinafter generally referred to jointly as "sealed") before use. This is necessary to make the article capable of withstanding liquid or gas pressure during use, and also to increase its density, improve its strength, reduce corrosion, and frequently to prepare the surface of the article for a subsequent painting or plating operation. A wide variety of porous metal articles are used commercially today, and are manufactured from a wide variety of metals. Zinc, copper, brass, iron, aluminum and various alloys are among the common metals needing to be sealed. Other important materials which frequently need to be sealed are wood and ceramics.

The prior art has recognized the need to seal these articles for many years. The earliest sealing process generally involved the use of either an inorganic sealant, such as sodium silicate, or a natural organic substance such as varnish. In more recent years, substances such as unsaturated alkyds, epoxides, and various other unsaturated monomers such as diallylphthalate have been used. See, for example, U.S. Pat. Nos. 3,345,205 to Raech, issued oct. 3, 1967, 2,932,583 to Grana, issued Apr. 12, 1960, and 2,554,254 to Kroft, issued May 22, 1951.

A substantially improved process for impregnating porous articles is taught by U.S. Pat. No. 3,672,942 to Neumann and Borowski, issued June 27, 1972, (the disclosure of which is incorporated herein by reference), which relates to impregnation with polymerizable anaerobic monomers, followed by surface treatment of the impregnated article with an organic solvent solution of an accelerator.

A major draw-back of the prior art systems is their need for solvent treatment to remove excess impregnant remaining on the surface of the article prior to cure, i.e., polymerization, of the impregnant. Use of solvents, of course, involves economic, toxicological and ecological disadvantages, for which reasons the search for aqueous-based substitutes has been vigorously pursued. Recent commercial systems have employed styrene-based polyester monomer impregnants which can be washed off the surface of articles by aqueous surfactant solutions; however, these monomers are not anaerobic and thus do not provide the substantial benefits associated with anaerobic impregnants, and the surfactant solutions must be used at elevated temperatures, e.g., about 150°F or higher, and for relatively long treatment times.

It has now been discovered that a specific, relatively narrow class of surfactants can be used in room temperature aqueous solution to dissolve certain anaerobic monomers. Thus, the present invention obviates the need for solvents in removing unwanted liquid anaerobics and is particularly advantageous for use in impregnation processes.

SUMMARY OF THE INVENTION

According to the present invention there is provided a process for dissolving anaerobic polymerizable monomers by treating the monomers with an aqueous surfactant solution. The useful surfactants conform to the general formula $X^1—O(C_2H_4O)_xX^2$; wherein $X^1$ is selected from the group consisting of A,$R^1$—A, $R^2$, and carbonyl; wherein A is an aryl group or a halogen- and/or lower alkyl-substituted aryl group; $R^1$ is a branched alkyl group containing about 3–12 carbon atoms or a linear or cyclo alkyl group containing about 1–20 carbon atoms; $R^2$ is a linear or cyclo alkyl group containing about 4–20 carbon atoms; $X^2$ is $X^1$ or H; and $x$ is between five and about 100 when $X^2$ is H and between seven and about 100 when $X^2$ is $X^1$. These surfactants are, in general, useful over a concentration range of about 1–30% by weight, the remainder being water and optional additives, and are effective at room temperature.

The useful polymerizable anaerobic monomers conform to the formula

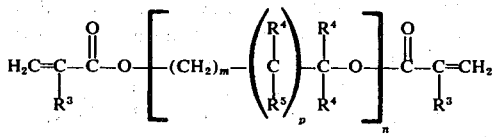

wherein $R^3$, $R^4$, $R^5$, $m$, $n$, and $p$ are as hereinafter defined.

Obviously, the invention may be utilized whenever it is desired to remove polymerizable anaerobic monomer liquid from surfaces which will not be damaged by contact with water. The invention is particularly advantageous when incorporated into an impregnation process as a means of removing excess or residual anaerobic monomer from the surface of impregnated porous articles. Thus, specifically, the present invention contemplates, in its broadest aspect, a process for removing a polymerizable anaerobic sealant from the surface of an article by dissolving at least a portion of the sealant, by treatment of the surface with an aqueous solution of the surfactant. The article need not necessarily be porous, although that is contemplated as the most frequent use. The invention also contemplates an impregnation process, at least one step of which involves removing a polymerizable anaerobic sealant by dissolving at least a portion of the sealant from the surface of a porous, rigid metal article impregnated with the sealant by treating a surface of the article with an aqueous solution of the surfactant. The invention further contemplates a process for sealing a porous article, at least one step of which involves removing by dissolving at least some of a polymerizable anaerobic sealant from the surface of the porous article to be sealed with the sealant by treating the surface of the article with an aqueous solution of the surfactant.

DETAILED DESCRIPTION OF THE INVENTION

The nature of the articles whose surface is to be treated by the present process is not a critical element of the invention. In most instances the process will be used to clean unpolymerized anaerobic sealant from the surface of porous metal articles which have been impregnated with the sealant. Porous metal articles are prepared by various methods known in the art, such as by casting of molten metal or sintering of powdered metal.

The sealants or impregnants intended for treatment by the process of this invention are anaerobic sealant compositions. In anaerobic compositions, oxygen serves to inhibit the polymerization of the monomers, thus making it possible to catalyze them well in advance of the time of intended use. As long as the monomer-catalyst mixture is properly exposed to oxygen, polymerization will not take place for extended periods of time, typically several months and in many cases for more than a year. However, under anaerobic (essentially oxygen free) conditions, the delicate balance between initiation and inhibition of polymerization is destroyed and the composition will begin to cure. Anaerobic conditions are reached in the interior of the porous metal parts but not at the surface of the parts, thus leaving a film of uncured monomer at the surface. The washing process of the present invention removes uncured monomer, thereby leaving the surface free of residual monomer and receptive to further processing.

The most desirable monomers for use in anaerobic systems are polymerizable acrylate esters. Preferably at least a portion of the acrylate monomer is a di- or other polyacrylate ester. These polyfunctional monomers produce cross-linked polymers, which serve as more effective and more durable sealants. While various anaerobic curing acrylate monomers may be used, limited by the solubility requirements described herein, the most highly preferred are polyacrylate esters which have the following general formula:

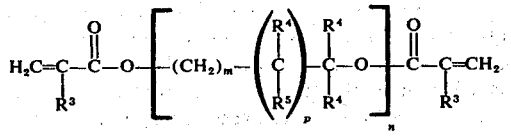

wherein $R^4$ represents a radical selected from the group consisting of hydrogen, lower alkyl of from 1 to about 4 carbon atoms, hydroxy alkyl of from 1 to about 4 carbon atoms, and

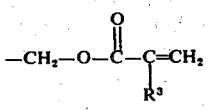

$R^3$ is a radical selected from the group consisting of hydrogen, halogen, and lower alkyl of from 1 to about 4 carbon atoms; $R^5$ is a radical selected from the group consisting of hydrogen, hydroxyl, and

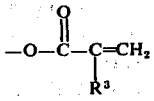

*m* may be 0 to about 12, and preferably from 0 to about 6; *n* is equal to at least 1, e.g., 1 to about 20 or more, and preferably between about 2 and about 6; and *p* is 0 or 1.

The polymerizable polyacrylate esters corresponding to the above general formula are exemplified by, but not restricted to, the following materials: di-, tri- and tetraethyleneglycol dimethacrylate, dipropyleneglycol dimethacrylate; polyethyleneglycol dimethacrylate; di(pentamethyleneglycol) dimethacrylate; tetraethyleneglycol diacrylate; tetraethyleneglycol di(-chloroacrylate); diglycerol diacrylate; diglycerol tetramethacrylate; tetramethylene dimethacrylate; ethylene dimethacrylate; and neopentylglycol diacrylate.

While polyacrylate esters, especially the polyacrylate esters described in the preceding paragraphs, have been found particularly desirable, monofunctional acrylate esters (esters containing one acrylate group) also may be used.

The most common of these monofunctional esters are the alkyl esters such as methyl methacrylate, ethyl methacrylate, propyl methacrylate and isobutyl methacrylate. Many of the lower molecular weight alkyl esters are quite volatile and frequently it is more desirable to use a higher molecular weight homolog, such a decyl methacrylate or dodecyl methacrylate.

When dealing with monofunctional acrylate esters, it is preferable to use an ester which has a relatively polar alcoholic moiety. Such materials are less volatile than low molecular weight alkyl esters and, in addition, the polar group tends to provide intermolecular attraction in the cured polymer, thus producing a more durable seal. Most preferably the polar group is selected from the group consisting of labile hydrogen, heterocyclic ring, hydroxy, amino, cyano, and halogen polar groups. Typical examples of compounds within this category are cyclohexylmethacrylate, tetrahydrofurfuryl methacrylate, hydroxyethyl acrylate, hydroxypropyl methacrylate, t-butylaminoethyl methacrylate, cyanoethylacrylate, and chloroethyl methacrylate.

Other acrylates can also be used. However, when other acrylates are used they preferably are used in combination with one or more members from either or both of the above-described classes of acrylate monomers. Most preferably, polyacrylates having the chemical formula given above, comprise at least a portion, preferably at least about 50 percent by weight of the acrylates used since these monomers have been found clearly superior in anaerobic sealants.

The sealant viscosity should be from about 1 to about 1000 centipoises and preferably is between about 5 and 500 centipoises. The most highly preferred range is from about 5 to about 150 centipoises. Viscosities higher than those indicated make penetration of the sealant into the porous part difficult or impossible and reduce the ease of dissolution; extremely low viscosity sealants tend to "leak" from the part subsequent to penetration. It should be recognized, however, that in certain sealing situations where relatively large gaps are to be closed and relative slowness of dissolution can be tolerated, much higher viscosity sealants (e.g., 10,000–100,000 centipoises) may be tolerable. Surface tension of the sealant also can effect these characteristics, but control of viscosity seems to be the more important factor. The ideal viscosity for any sealant will be a function of the solubility of the sealant, the particular surfactant to be used, and the pore size of the porous part to be impregnated, and can be determined easily with a minimum of routine tests.

The monomers described above are given anaerobic characteristics by incorporating therein an appropriate polymerization initiator system. The initiator must be capable of inducing polymerization of the monomer or monomers in the substantial absence of oxygen, and yet not induce polymerization as long as oxygen is present. Since the unsaturated monomers used as impregnants in this invention are conveniently cured through a free-radical mechanism, the most common initiator system is a redox polymerization initiator, i.e., an ingredient or a combination of ingredients which produce an oxidation-reduction reaction, resulting in the production of free radicals. The most common initiator systems of this type are those involving peroxy materials which, under the appropriate conditions, decompose to form peroxy free radicals.

A class of peroxy initiators which has been found readily adaptable to the anaerobic concept, and particularly efficient when used in combination with the acrylate monomers described above, is the hydroperoxy initiators. Of this class, the organic hydroperoxides and compounds such as peracids and peresters which hydrolyze or decompose to form organic hydroperoxides are the most preferred. Cumene hydroperoxide has been used with particular success.

For purposes of versatility, it frequently is desirable to incorporate in the impregnant various additives, for example, various classes of accelerators of hydroperoxide decomposition. Typical examples are tertiary amines such as tributyl amine, sulfimides such as benzoic sulfimide, formamide, and compounds containing transition metals, such as copper octanoate.

While the amount of redox polymerization initiator in the impregnant can vary over wide ranges, it is impractical for such an initiator to comprise more than about 10% by weight of the impregnant, and it preferably does not comprise more than about 5% of the impregnant by weight. Most preferably the redox polymerization initiator comprises from about 0.2% to about 3% by weight of the impregnant. The weight percent of the redox polymerization initiator in the impregnant should not be allowed to decrease below about 0.1%, since below that level the cure of the impregnant will be unduly slow.

Frequently it may be desirable to add one or more comonomers to the acrylate system to, e.g., modify the viscosity, solvent resistance, or other characteristics of the cured or uncured impregnant. While a mixture of acrylates often can be used successfully, other unsaturated comonomers can be used as well. These comonomers generally will be monomers capable of relatively rapid vinyl-type polymerization so that they can copolymerize, at least to a limited extent, with the reactive acrylate monomers. For example, alkyd resins such as (dimethyldiphenyl methane)-fumarate and diethyleneglycol maleate phthalate, and other unsaturated monomers such as di-allylphthalate and dimethylitaconate can be used successfully. Likewise, prepolymers of the above-named co-monomers up to about molecular weight 3000 can be used.

When non-acrylate co-monomers are used, they preferably should not be used in amounts which exceed about 50% of the total weight of the acrylate monomer in the system. Other ingredients can be added to the impregnant as well, provided they do not adversely affect the sealing function of the composition or interfere substantially with the solubility of the sealant in the detergent formulations of this invention.

The impregnant described above cures under the anaerobic conditions of the interior of the article to form a hard, durable resin. However, at the surface of the article there is sufficient contact with oxygen to leave a thin film of the impregnant in the uncured, or more likely, partially cured state. This film is undesirable since the uncured impregnant can contaminate its surroundings upon removal by normal abrasion or by various liquids. More important, this film tends to interfere with the subsequent painting or plating operations which frequently are performed upon the metal articles, and generally will be removed during the painting or plating operations to contaminate any painting or plating baths which are used.

Whereas the prior art processes utilize organic solvents to remove this residual uncured sealant, the present process advantageously utilizes aqueous solutions of particular surfactants, as previously mentioned. The useful surfactants are nonionic and conform to the general formula $X^1—O(C_2H_4O)_xX^2$ wherein $x$ is at least about five but preferably less than about 100, more preferably less than about 30, and most preferably about 8–11 when $X^2$ is H but the lower limit is at least about seven when $X^2$ is $X^1$, and $X^1$ is selected from the group consisting of A, $R^1$-A, $R^2$, and carbonyl, wherein A is an aryl group or a halogen-and/or lower alkyl-substituted aryl group; $R^1$ is a branched alkyl group containing about 3–12 carbon atoms, preferably about 8–10 carbon atoms, or a linear or cyclo alkyl group containing about 1–20 carbon atoms; $R^2$ is a linear or cyclo alkyl group containing about 4–20 carbon atoms, preferably about 10–14 carbon atoms; and $X^2$ is $X^1$ or H. It will also be understood that $X^1$ and $X^2$ may also contain any substituents which do not interfere with the functioning of the surfactant in this invention. The essential part of the molecule appears to be the ethylene oxide moiety, and this moiety may also contain ethylene oxide branches, provided that the numerical limitations on the ethylene oxide units are met. Below about five ethylene oxide units (e.g., x=4) the surfactant solution appears to lose the ability to dissolve the polymerizable anaerobic sealant (but still may be able to emulsify it). Since the water solubility of polyethylene oxides tends to increase with molecular weight, there should be no particular upper limit on the number of ethylene oxide units; however, as a practical matter, 100 units is a reasonable maximum.

Illustrative, but not limiting, of the class of useful surfactants are the alkylphenyl ethers of ethylene, polyoxyethylene glycols and their ethers, and (poly) oxyethylenated alkylphenols and their ethers. Typical examples are:

"Triton" X-114 Polyoxyethylenated t-octylphenol (7–8 moles ethylene oxide)

"Triton" X-100 Polyoxyethylenated t-octylphenol (9–10 moles ethylene oxide)

"Igepal" CO-850 Polyoxyethylenated nonylphenol (20 moles ethylene oxide)

"Igepal" CO-990 Polyoxyethylenated nonylphenol (100 moles ethylene oxide)

("Triton" is a tradename of Rohm & Haas Co., Philadelphia, Pa.; and "Igepal" is a tradename of GAF Corp., N.Y., N.Y.)

Further illustrative of the useful surfactants are alkyl ethers of ethylene and polyoxyethylene glycols and their ethers, and (poly) oxyethylenated alcohols and their ethers. Typical examples are:

"Alfonic" 1012-60 Polyoxyethylenated $C_{10}$ and $C_{12}$ alcohols (60% ethylene oxide)

"Lipal" 9LA Polyoxyethylenated lauryl alcohol (9 moles ethylene oxide)

"Siponic" L-25 Polyoxyethylenated lauryl alcohol (25 moles ethylene oxide)

"Renex" 30 Polyoxyethylenated tridecyl alcohol (12 moles ethylene oxide)

("Alfonic" is a tradename of Continental Oil Co., Saddle Brook N.J., "Lipal" is a tradename of Drew Chemical Corp., Boonton, N.J.; "Siponic" is a tradename of Alcolac Chemical Corp., Baltimore, Md.; and "Renex"

is a tradename of Atlas Chemical Industries, Wilmington, Del.)

The concentration of the surfactant in the aqueous solution may vary from about 1 to about 30 percent by weight, preferably about 5–15 percent by weight. The key to the effectiveness of this particular class of surfactants is their ability to dissolve the anaerobic sealants previously described. Naturally, the extent of solubilization of a sealant/surfactant system will be a function of the particular materials selected, so that optimizing the solubility may require a minor amount of routine experimentation. As an example of such a solubilization function, the solubilization ratio for the "Triton" 100/polyethylene glycol dimethacrylate (MW=330) system is approximately 2:1; that is, a 10 percent aqueous solution of "Triton" 100 will dissolve about 5 percent polyethylene glycol dimethacrylate. By the term "dissolve" is meant the ability to solubilize, i.e., form an essentially clear solution of, the anaerobic monomer to the extent of at least about 0.1 percent; for example, 100 grams of surfactant/water solution must be capable of dissolving at least about 0.1 gram of polymerizable anaerobic sealant. Preferably the solubilization will be at least about 0.5 percent. More commonly, the solubilization will be about 2–5 percent, or more.

A particular advantage of these surfactants is that their aqueous solutions may be utilized at room temperature. However, warm or even hot temperatures may be used if desired.

Treatment of the impregnated articles with the aqueous surfactant solution may be performed by any convenient method. For example, the articles may be placed on racks, and sprayed with the surfactant solution. The most desirable method of treatment is by dipping the articles into a tank containing the surfactant solution. Preferably, the tank will be moderately agitated, although it is an advantage of this invention that extreme agitation is not required. Length of the treatment need only be such as will provide adequate removal of the anaerobic sealant and may be readily determined by simple experimentation for various combinations of sealant, surfactant, concentration and agitation. In the great majority of cases, the treatment time will be less than one minute, typically less than 20 or 30 seconds.

A typical prior art process for impregnation of porous metal articles with a polymerization anaerobic sealant will comprise the sequential steps of cleaning and degreasing the articles, impregnating them with the anaerobic sealant containing a peroxy initiator, followed by organic solvent rinse to remove excess surface sealant and/or leave the surface free of sealant. This latter step is now preferably replaced by the aqueous rinse of the present invention. Other steps may also be included in the impregnation process, such as the aeration step and the polymerization accelerator solution rinse taught by U.S. Pat. No. 3,672,942, previously cited. In particular, this invention is useful in the process for sealing porous rigid articles which comprises:

a. preparing an anaerobic sealant comprising a polymerizable acrylate ester monomer and a hydroperoxide polymerization initiator therefor:
b. aerating the sealant in a vacuum vessel at a sufficient rate to prevent polymerization of the anaerobic sealant;
c. submerging porous rigid articles to be sealed in the anaerobic sealant;
d. discontinuing the aeration and drawing a vacuum in the vessel of less than about five inches of mercury absolute pressure;
e. after the interstices of the article have been evacuated, releasing the vacuum to force the anaerobic sealant into the interstices; and
f. removing the impregnated article from the anaerobic sealant and treating the surfaces of the article with an aqueous solution of a surfactant of this invention.

While U.S. Pat. No. 3,672,942 emphasizes the use of an organic solvent solution for the accelerator rinse, the solvent acting as a removal agent for residual anaerobic sealant on the surface of the articles, it will be observed by those skilled in the art that selection of a water-soluble accelerator will permit use in this step of the aqueous surfactant solution of this invention. Thus, it will be appreciated that the scope of the present invention includes both an impregnation process wherein there is the additional step of treating the surface of the surfactant-washed articles with an accelerator in organic solution, and also a process wherein an accelerator in aqueous solution is used and a surfactant of this invention is also contained in the accelerator solution. Similarly, it will be appreciated that the scope of this invention includes a polymerization acceleration step utilizing hot water containing a surfactant of this invention, it being known in the art that a hot water rinse will accelerate the cure of many vinyl-type sealants.

The following examples illustrate the invention but are not intended to limit it in any way. All formulations are given on a weight basis.

EXAMPLE I

A blend of acrylate monomers was prepared by mixing ⅔ by weight of triethyleneglycol dimethacrylate with ⅓ by weight lauryl methacrylate. To this mixture was added approximately 1% by weight cumene hydroperoxide, approximately 0.3% by weight benzoic sulfimide, and about three parts per million by weight copper (as copper octanoate). Approximately 20 gallons of this mixture was transferred to a vacuum tank (approx. 10 cu. ft.) equipped with flexible connections to a vacuum pump. A one-quarter inch polyethylene aeration line was connected from the bottom of the tank to an air compressor. Aeration was commenced immediately upon transfer of the impregnant to the tank, air being supplied at a pressure of 6 p.s.i.g.

To test the stability of the impregnant, aeration was continued for approximately 2 days during which time the anaerobic mixture remained liquid. No significant change in viscosity was noticed, indicating the absence of any significant amount of polymerization.

The mixture was then used to impregnate die-cast aluminum parts (rectangular solid meter housings, approximately 3 inches ×2 inches ×1¾ inches). The part contained ten threaded "blind" holes. Prior to impregnation the aluminum parts were water-washed and vapor phase-degreased to insure cleanliness. The cleaned parts were placed in a stainless steel rack and suspended in the impregnation tank with the parts completely submerged in the impregnant. The tank was closed, sealed, and the air was evacuated by means of the vacuum pump.

An absolute pressure of approximately one inch of mercury was reached in less than 2 minutes, and this vacuum was maintained for about 10 minutes. Thereafter the vacuum pump was turned off and the pressure in the tank gradually increased by means of a bleed valve. After the pressure had reached atmospheric pressure, the tank was opened and the tray of impregnated parts was removed from the liquid and allowed to drain for about five minutes. The tray then was submerged in a water solution containing 10% "Triton" X-100. After about 10–30 seconds, with slight agitation, the tray was removed from the surfactant solution and was submerged in a water solution containing 2% thiourea (which is an accelerator of free radical polymerization). After about 10 seconds the tray was removed and the parts were allowed to stand for about 6 hours at room temperature to allow full hardening of the sealant to take place.

The sealed porous metal pieces were found to have a smooth, clean surface with no visible evidence of sealant on any of the outer surfaces, including the inner surfaces of the blind holes. The sealant was found to have cured essentially to the outer surface of the castings.

EXAMPLE II

The procedure of Example I is repeated except the surfactant used is "Alfonic" 1012-60 and the accelerator is N,N'-dimethyl thiourea. Similar results are obtained.

EXAMPLE III

The procedure of Example I is repeated except the acrylate monomer is 1,3-butyleneglycol dimethacrylate. Similar results are obtained.

EXAMPLE IV

Solutions were prepared by dissolving in water 10 percent by weight of the following surfactants: polyethylene glycol (MW=400) monolaurate, polyethylene glycol (MW=600) monolaurate, "Triton" N-101 polyethylenated nonylphenol (9–10 ethylene oxide units), and "Triton" CF-21 alkylaryl polyether. To each of these solutions was added, with gentle stirring, 2 percent polyethylene glycol dimethacrylate (MW=330), a common anaerobic monomer. In each case a clear solution was formed in a short time.

We claim:

1. A process for removing a polymerizable anaerobic sealant from the surface of an article comprising treating said surface with an aqueous solution of a nonionic surfactant having the formula $X^1—O(C_2H_4O)_xX^2$ wherein $X^1$ is selected from the group consisting of A,$R^1$—A, $R^2$, and carbonyl, wherein A is an aryl group or a halogen- and/or lower alkyl-substituted aryl group; $R^1$ is a branched alkyl group containing about 3–12 carbon atoms or a linear or cyclo alkyl group containing about 1–20 carbon atoms; $R^2$ is a linear or cyclo alkyl group containing about 4–20 carbon atoms; $X^2$ is $X^1$ or H; and x is between five and about 100 when $X^2$ is H but beween about seven and 100 when $X^2$ is $X^1$; and wherein at least a portion of the polymerizable anaerobic sealant has the formula

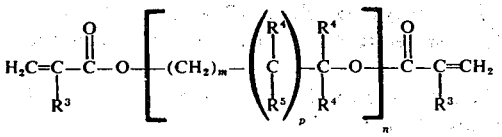

wherein $R^4$ represents a radical selected from the group consisting of hydrogen, lower alkyl of from 1 to about 4 carbon atoms, hydroxy alkyl of from 1 to about 4 carbon atoms, and

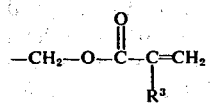

$R^3$ is a radical selected from the group consisting of hydrogen, halogen and lower alkyl of from 1 to about 4 carbon atoms; $R^5$ is a radical selected from the group consisting of hydrogen, hydroxyl and

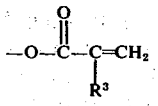

*m* is 0 to about 12, *n* is at least 1, and *p* is 0 or 1; in admixture with a peroxy initiator of the cure of the anaerobic sealant.

2. The process of claim 1 wherein said surface is a surface of a metal casting impregnated with the anaerobic sealant.

3. The process of claim 1 wherein the treatment is carried out at room temperature.

4. The process of claim 1 wherein the concentration of the surfactant solution is from about 1 to about 30 percent by weight.

5. The process of claim 4 wherein the concentration of the surfactant solution is from about 5 to about 15 percent by weight.

6. An impregnation process comprising the steps of (a) impregnating a porous metal article with a polymerizable anaerobic sealant wherein at least a portion of the polymerizable anaerobic sealant has the formula

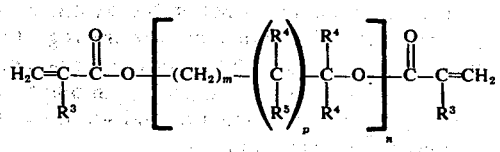

wherein $R^4$ represents a radical selected from the group consisting of hydrogen, lower alkyl of from 1 to about 4 carbon atoms, hydroxy alkyl of from 1 to about 4 carbon atoms, and

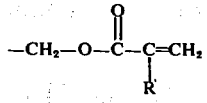

$R_3$ is a radical selected from the group consisting of hydrogen, halogen and lower alkyl of from 1 to about 4 carbon atoms; $R^5$ is a radical selected from the group consisting of hydrogen, hydroxyl and

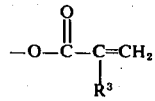

$m$ is 0 to about 12, $n$ is at least 1, and $p$ is 0 or 1; in admixture with a peroxy initiator of the cure of the anaerobic sealant; (b) removing at least some of the polymerizable anaerobic sealant remaining on the surface of the metal article by treating said surface with an aqueous solution of a surfactant having the formula $X^1—O(C_2H_4O)_xX^2$ wherein $X^1$ is selected from the group consisting of A,$R^1$—A, and $R^2$, and carbonyl, wherein A is an aryl group of a halogen- and/or lower alkyl-substituted aryl group; $R^1$ is a branched alkyl group containing about 3–12 carbon atoms or a linear or cyclo akyl group containing about 1–20 carbon atoms; $R^2$ is a linear or cyclo alkyl group containing about 4–20 carbon atoms; $X^2$ is $X^1$ or H; and x is between five and about 100 when $X^2$ is H but between about seven and about 100 when $X^2$ is $X^1$; and (c) permitting the anaerobic sealant to cure.

7. The process of claim 6 comprising, in addition, accelerating the cure by treatment of said surface with a solution of an accelerator of the polymerization of the anaerobic sealant.

8. The process of claim 7 wherein the polymerization accelerator comprises: aldehyde-amine condensation products; sulfur-containing free-radical accelerators; or organic compounds containing an oxidizable transition metal.

9. The process of claim 7 wherein the accelerator is in aqueous solution.

10. The process of claim 9 wherein the aqueous solution also contains a surfactant of this invention.

11. The process of claim 6 wherein the treatment is carried out at room temperature.

12. The process of claim 6 wherein the concentration of the surfactant solution is from about 1 to about 30 percent by weight.

13. The process of claim 12 wherein the concentration of the surfactant solution is from about 5 to about 15 percent by weight.

14. The process of claim 6 wherein the treatment of step (b) is performed by immersing the impregnated metal article in an aqueous solution of the surfactant.

15. The process of claim 6 comprising, in addition, accelerating the cure by treatment of said surface with water at an elevated temperature.

16. The process of claim 15 wherein the water at elevated temperature contains a surfactant of this invention.

17. A process for sealing a porous article comprising the steps of (a) impregnating the article with a polymerizable anaerobic sealant wherein at least a portion of the polymerizable anaerobic sealant has the formula

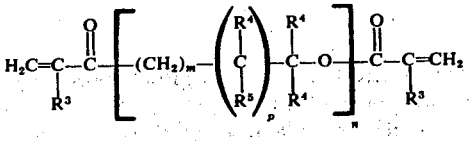

wherein $R^4$ represents a radical selected from the group consisting of hydrogen, lower alkyl of from 1 to about 4 carbon atoms, and

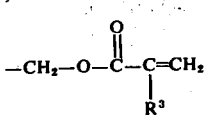

$R^3$ is a radical selected from the group consisting of hydrogen, halogen and lower alkyl of from 1 to about 4 carbon atoms; $R^5$ is a radical selected from the group consisting of hydrogen, hydroxyl and

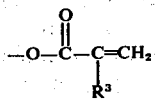

$m$ is 0 to about 12, $n$ is at least 1, and $p$ is 0 or 1; in admixture with a peroxy initiator of the cure of the anaerobic sealant; (b) removing at least some of the anaerobic sealant remaining on the surface of the article by treating said surface with an aqueous solution of a surfactant having the formula $X^1—O(C_2H_4O)_xX^2$ wherein $X^1$ is selected from the group consisting of A, $R^1$—A, $R^2$, and carbonyl, wherein A is an aryl group or a halogen- and/or lower alkyl-substituted aryl group, $R^1$ is a branched alkyl group containing about 3-12 carbon atoms or a linear or cyclo alkyl group containing about 1-20 carbon atoms; $R^2$ is a linear or cyclo alkyl group containing about 4-20 carbon atoms; $X^2$ is $X^1$ or H; and $x$ is between five and about 100 when $X^2$ is H but between about seven and about 100 when $X^2$ is $X^1$; and (c) permitting the anaerobic sealant to cure.

18. The process of claim 17 wherein the porous article is a metal casting.

19. The process of claim 17 comprising, in addition, accelerating the cure by treatment of said surface with a solution of an accelerator of the polymerization of the anaerobic sealant.

20. The process of claim 19 wherein the polymerization accelerator is selected from the group consisting of the following classes: aldehyde-amine condensation products; sulfur-containing free-radical accelerators; and organic compounds containing an oxidizable transition metal.

21. The process of claim 19 wherein the accelerator is in aqueous solution.

22. The process of claim 21 wherein the aqueous solution also contains a surfactant of this invention.

23. The process of claim 17 wherein the treatment is carried out at room temperature.

24. The process of claim 17 wherein the concentration of the surfactant solution is from about 1 to about 30 percent by weight.

25. The process of claim 24 wherein the concentration of the surfactant solution is from about 5 to about 15 percent by weight.

26. The process of claim 17 wherein the treatment of step (b) is performed by immersing the impregnated metal article in an aqueous solution of the surfactant.

27. The process of claim 17 comprising, in addition, accelerating the cure by treatment of said surface with water at an elevated temperature.

28. The process of claim 27 wherein the water at elevated temperature contains a surfactant of this invention.

29. The process of claim 1 wherein x is 8-11, $X^1$ is $R^1$—A, and $X^2$ is H.

30. The process of claim 29 wherein $R^1$ contains 8–10 carbon atoms.

31. The process of claim 6 wherein x is 8–11, $X^1$ is $R^1$—A, and $X^2$ is H.

32. The process of claim 31 wherein $R^1$ contains 8–10 carbon atoms.

33. The process of claim 17 wherein x is 8–11, $X^1$ is $R^1$—A, and $X^2$ is H.

34. The process of claim 33 wherein $R^1$ contains 8–10 carbon atoms.

35. The process for sealing porous rigid articles which comprises:

a. preparing an anaerobic sealant comprising a polymerizable acrylate ester monomer and a hydroperoxide polymerization initiator therefore wherein at least a portion of the polymerizable acrylate ester has the chemical formula

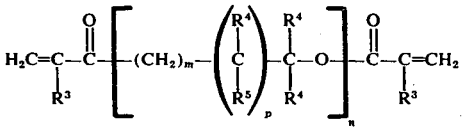

wherein $R^4$ represents a radical selected from the group consisting of hydrogen, lower alkyl of from 1 to about 4 carbon atoms, hydroxy alkyl of from 1 to about 4 carbon atoms, and

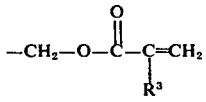

$R^3$ is a radical selected from the group consisting of hydrogen, halogen and lower alkyl of from 1 to about 4 carbon atoms, $R^5$ is a radical selected from the group consisting of hydrogen, hydroxyl, and

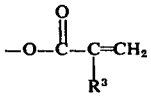

*m* is 0 to about 12, *n* is at least 1, and *p* is 0 to 1;

b. aerating the sealant in a vacuum vessel at a sufficient rate to prevent polymerization of the anaerobic sealant;

c. submerging porous rigid articles to be sealed in the anaerobic sealant;

d. discontinuing the aeration and drawing a vacuum in the vessel of less than about five inches of mercury absolute pressure;

e. after the interstices of the articles have been evacuated, releasing the vacuum to force the anaerobic sealant into the interstices; and f. removing the impregnated article from the anaerobic sealant and treating the surfaces of the article with an aqueous solution of a surfactant of this invention.

36. The process of claim 35 comprising the additional step of accelerating the cure by treating the surfaces of the article with an aqueous solution of an accelerator of free-radical polymerization.

37. The process of claim 35 wherein the vacuum is less than about one inch of mercury absolute pressure.

* * * * *

UNITED STATES PATENT OFFICE
CERTIFICATE OF CORRECTION

Patent No. 3,969,552 Dated July 13, 1976

Inventor(s) Bernard M. Malofsky, Elliott Frauenglass, and Harold A. Fowler

It is certified that error appears in the above-identified patent and that said Letters Patent are hereby corrected as shown below:

In Claim 6, at column 10, line 55, the formula should be changed to read:

$$-CH_2-O-\overset{\overset{\displaystyle O}{\|}}{C}-\underset{\underset{\displaystyle R^3}{|}}{C}=CH_2$$

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademark*